US006840830B1

(12) United States Patent
Harlan

(10) Patent No.: US 6,840,830 B1
(45) Date of Patent: Jan. 11, 2005

(54) BUOYANT RING LOUNGER

(75) Inventor: Matthew Harlan, 713 E. Washington St., Iowa City, IA (US) 52240

(73) Assignee: Matthew Harlan, Clive, IA (US)

( * ) Notice: Subject to any disclaimer, the term of this patent is extended or adjusted under 35 U.S.C. 154(b) by 0 days.

(21) Appl. No.: 10/417,850

(22) Filed: Apr. 16, 2003

(51) Int. Cl.[7] ..... B63B 9/04
(52) U.S. Cl. ..... 441/35; 441/131
(58) Field of Search ..... 441/35, 40, 131, 441/133; 114/346

(56) References Cited

U.S. PATENT DOCUMENTS 3,602,930 A * 9/1971 Channon ..... 441/65
3,656,749 A * 4/1972 Reyes ..... 473/485
4,358,866 A * 11/1982 Rhodes ..... 114/363
4,367,689 A * 1/1983 Lukehart et al. ..... 114/346
4,516,943 A * 5/1985 Spieldiener et al. ..... 441/35
4,750,894 A * 6/1988 Nealey ..... 441/40
4,939,183 A * 7/1990 Abu-Isa et al. ..... 521/138
5,330,378 A * 7/1994 Park ..... 441/133
5,518,431 A 5/1996 Staley
5,571,036 A 11/1996 Hannigan
6,485,344 B2 11/2002 Arias

* cited by examiner

*Primary Examiner*—Stephen Avila
(74) *Attorney, Agent, or Firm*—Brett J. Trout

(57) ABSTRACT

A buoyant lounger. The buoyant lounger has an outer loop constructed of a plurality of releasably secured resilient foam sections. A resilient containment band is placed within the outer loop and a plurality of mesh chairs are coupled between the containment band and the outer loop to produce a floating, buoyant lounger, which can accommodate a plurality of users. The buoyant lounger may be quickly and easily disassembled for transport and storage.

20 Claims, 3 Drawing Sheets

BUOYANT RING LOUNGER

BACKGROUND OF THE INVENTION

1. Field of the Invention

The present invention relates to buoyant loungers, and more specifically to a multi-user, non-inflatable buoyant lounger which may be easily disassembled for transport and storage.

2. Description of the Prior Art

It is known in the art to provide a collapsible floatation device, including a semi-rigid exterior defining a perimeter to encompass a user. One example of such a lounger is U.S. Pat. No. 6,485,344 to Resrarias. One drawback associated with such a device is that the device requires inflation, which leads to problems associated with over-inflation, under-inflation and puncture. Additionally, inflating such a device is time consuming, often requiring the utilization of a pump or similar device. Another drawback associated with such a device is that it provides no means for accommodating a plurality of users.

Another type of device, known in the art such as that described in U.S. Pat. No. 5,518,431 to Staley accommodates a plurality of users, but has several additional drawbacks. Additionally, such devices include all of the drawbacks associated with inflatability described above. Although this device discusses the utilization of styrofoam blocks disposed within the inflatable area of the device, the device still requires inflation and is subject to loss of buoyancy or rigidity upon puncture or over-inflation of the device. An additional drawback associated with the device is that the device cannot accommodate more than four users. Still another drawback associated with this device is the absence of an unobstructed area for a user to enter or exit the device. Yet another drawback associated with such a device is the cost of constructing and maintaining the device.

Another prior art device is taught in U.S. Pat. No. 5,571,036 to Hannigan. Hannigan teaches an improved floatation support comprising one or more buoyant flexible foam tubes coupled to a sling in a U-shape to support a user. Although such devices overcome the problems associated with inflatable loungers described above, this device is designed for only a single user, and does not provide means for expanding use to additional users or providing individual seating areas.

Accordingly, it would be desirable to provide a buoyant lounger which avoids the under-inflation, over-inflation, puncture and inflation problems associated with prior art inflatable loungers. It would be additionally advantageous to provide a lounger which could accommodate multiple users. It would also be advantageous to provide a multi-user lounger which provides for ease of ingress and egress, and which was of a low-cost manufacture and maintenance. The difficulties encountered in the prior art described hereinabove are substantially eliminated by the present invention.

SUMMARY OF THE INVENTION

In an advantage provided by the present invention, a buoyant lounger is provided which is of a lightweight, low-cost manufacture.

Advantageously, the present invention provides a buoyant lounger which is not susceptible to substantial loss of buoyancy due to puncture;

Advantageously, the present invention provides a buoyant lounger with an entrance/egress;

Advantageously, the present invention provides a buoyant lounger capable of accommodating multiple users;

Advantageously, the present invention provides a buoyant lounger which may be quickly and easily assembled without tools;

Advantageously, the present invention provides a buoyant lounger which may be quickly disassembled into lightweight, compact orientation for transport and storage.

The present invention relates to a floatation lounger for use on water. The floatation lounger includes a loop formed of a flexible resilient foam tube, and a containment band positioned within a perimeter defined by the loop. Seats are coupled between the loop and the containment band to provide seating for a plurality of users. In the preferred embodiment, the seats are constructed of netting. The netting defines a sleeve at one end provided around the loop, and a sleeve at the other then provided around the containment band, to create a seat, a back and a pair of bolsters when containing a user. Preferably, the loop is constructed of a plurality of resilient foam tubes, releasably coupled to one another for ease of assembly, disassembly, transport and storage.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
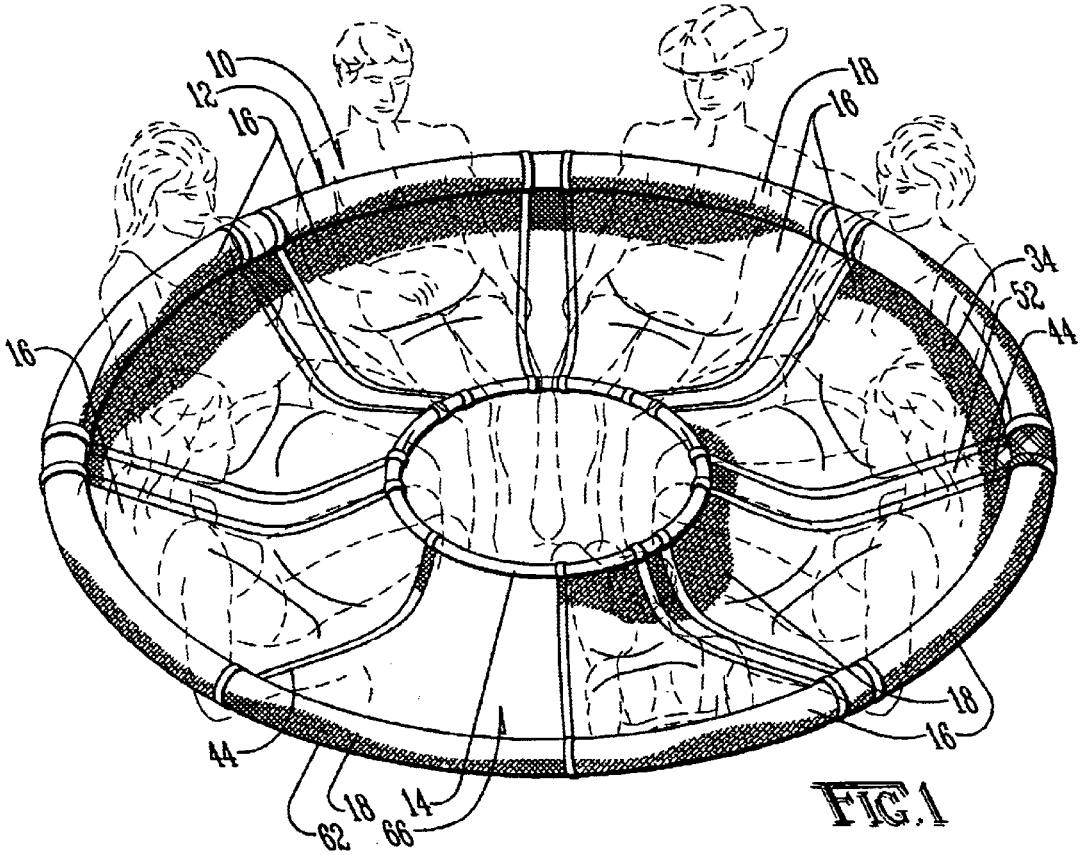
FIG. 1 illustrates a top perspective view of the buoyant lounger of the present invention.
Figure 2:
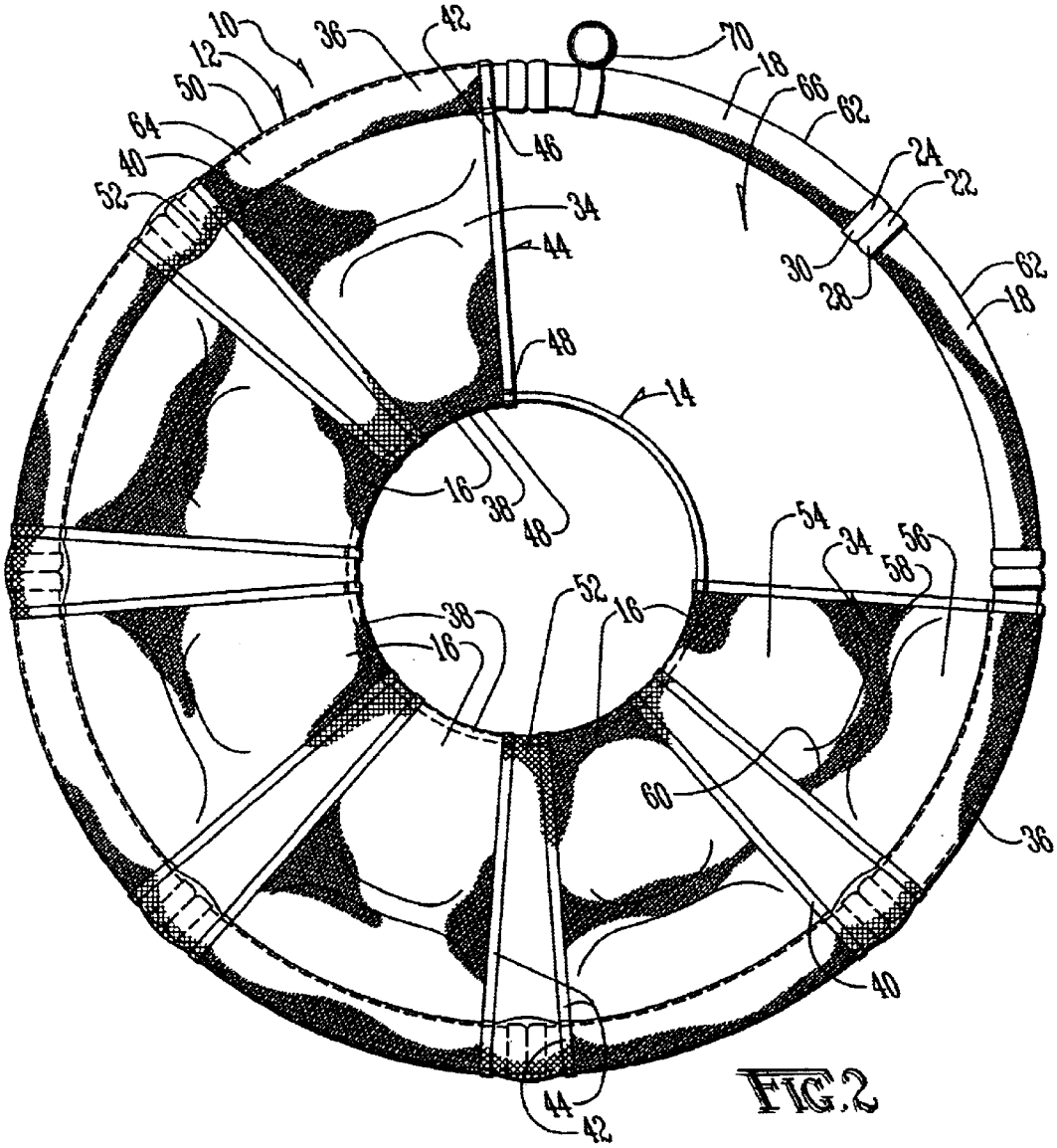
FIG. 2 illustrates a top plan elevation of the buoyant lounger of the present invention.
Figure 3:
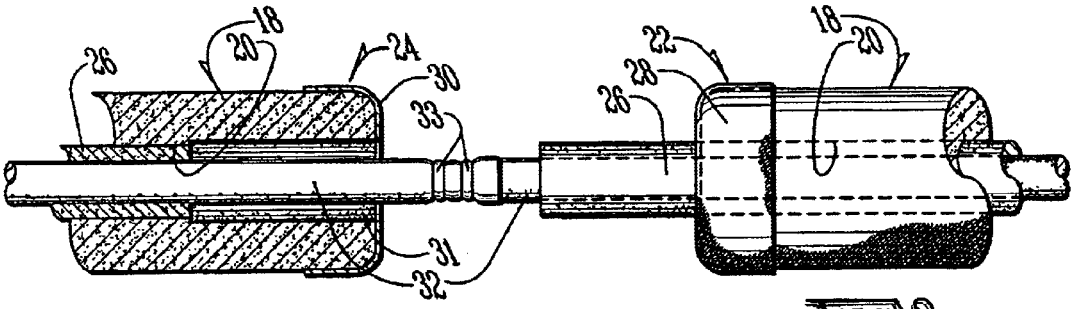
FIG. 3 illustrates a side elevation in partial cross-section of the mating ends of two resilient foam tube section of the buoyant lounger of the present invention.

The buoyant lounger of the present invention is shown generally as (10) in FIGS. 1 and 2. The buoyant lounger (10) is provided with an exterior loop (12) coupled to an interior containment band (14) by a plurality of seats (16). The outer loop (12) is constructed of a plurality of resilient foam sections (18), such as those shown generally as (18) in FIG. 3. As shown in FIG. 3, each resilient foam section (18) is preferably a closed cell blown foam polymer, such as polypropylene, polyethylene, or polystyrene. Each section (18) is preferably a thirty-six inch long cylindrical tube with a four-inch diameter, but may be, of course, of any suitable size, dimension or construction, all of which determine the buoyancy of a particular section. For more buoyancy, a thicker or less dense section may be used. Each section (18), as well as all other parts of the lounger (10) are preferably constructed of an ultraviolet stabilized material, or are coated with an ultraviolet stabilizing coating, such as those known in the art.

As shown in FIG. 3, each section (18) is preferably provided with a hollow cylindrical interior (20) running the length of the section (18), but may be solid if it is desired to utilize an alternative connection method, other than this preferred embodiment. Each section (18) is preferably provided with a head (22) and a foot (24). A stiffening tube (26) preferably constructed of polyvinylchloride or similar resilient material is positioned within the hollow cylindrical interior of each section (18). Secured over the head (22) of each section and to the stiffening tube (26) is a head cap (28), also constructed of polyvinylchloride. A foot cap (30), constructed of similar material, is secured over the foot (24) of each section (18), and to the stiffening tube (26). Preferably the foot cap (30) is provided with a receiver tube (31) which extends into the hollow cylindrical interior (20) of a section (18) to be secured thereto. Preferably, the receiver tube (31) is provided with a cylindrical interior of a sufficient diameter to receive the stiffening tube (26), running through the hollow cylindrical interior (20), as well as a portion of a stiffening tube (26), extending from an adjacent section (18). As shown in FIG. 3, a circular length of shock cord (32) is provided through the hollow cylindrical interiors (20) of all the sections (18). The shock cord (32) is preferably constructed of a plurality of continuous rubber bands, wrapped with an abrasion resistant nylon jacket. The ends of the shock cord (32) are coupled together with two compressible rings (33) sufficiently small to pass through the stiffening tube (26). The ends of the shock cord (32) may be, of course, coupled together by any means known in the art which is sufficiently small and smooth enough to effectively slide through the stiffening tube (26). In place of the shock cord (32), any resilient material may be used. Alternatively, non-resilient material which may be tightened and bound may be used instead. A plurality of resilient foam sections can be connected to one another by alternately inserting the portion of stiffening tube (26) extending from one resilient foam section (18) into the receiver tube (31) of an adjacent resilient foam section (18).

Figure 4:
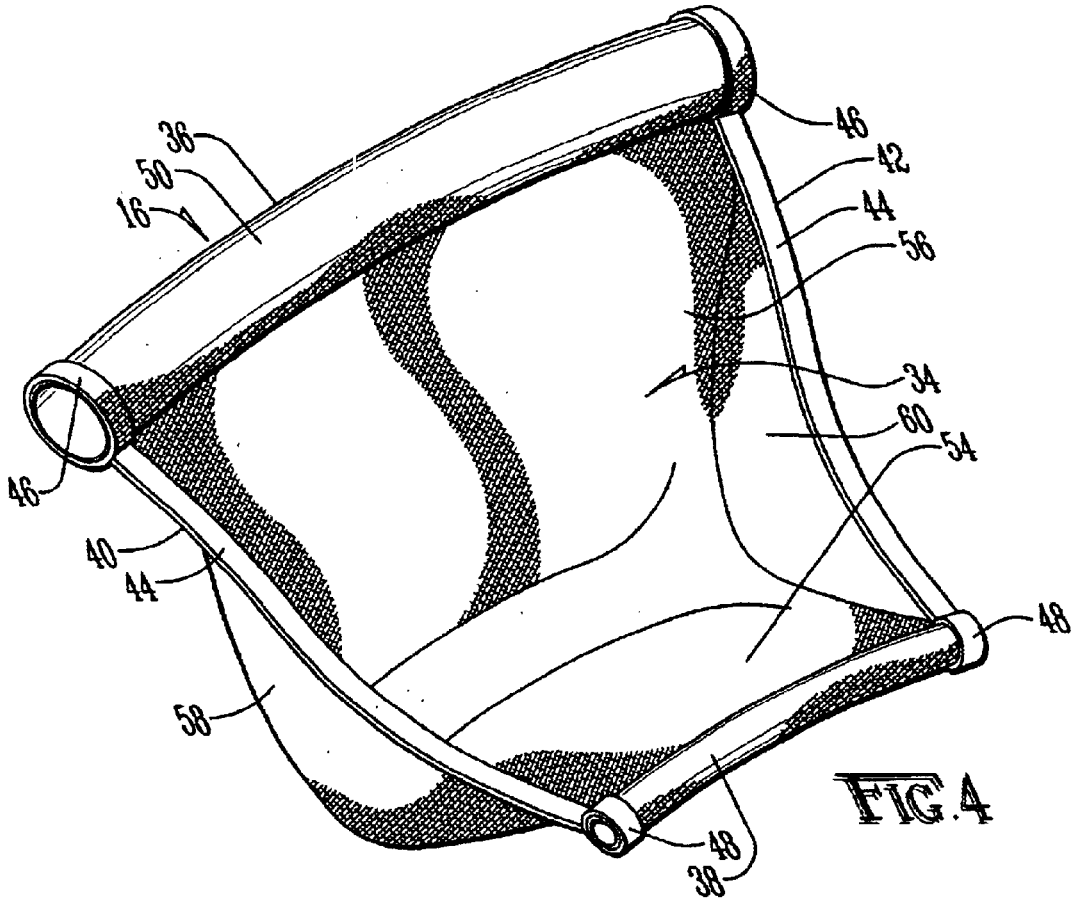
FIG. 4 illustrates a top perspective view of a seat of the buoyant lounger of the present invention.

As shown in FIG. 2, the lounger (10) is provided with a plurality of seats (16). As shown in FIG. 4, each seat is preferably constructed of a flat, trapezoidal sheet of mesh material, such as nylon or polyurethane coated nylon. The seat (16), of course, may be constructed of any suitable material, and may be woven or produced from an integral sheet. Preferably, however, the seat (16), as well as all components of the lounger (10), are constructed of a material which dries quickly and is resistant to pool chemicals, as well as the growth of mold and mildew.

Each seat (16) has a head section (36), a foot section (38), a first side (40) and a second side (42). Sewn or otherwise secured along the first side (40) and second side (42) of each seat (16), between the head section (36) and foot section (38), lengths one-inch thick nylon webbing (44). The lengths of nylon webbing (44) are preferably each provided with an upper loop (46) and lower loop (48) to extend around the outer loop (12) and containment band (14) respectively. (FIGS. 2 and 4). The lengths of nylon webbing (44) are not very resilient, and may be replaced with shock cord or similar resilient material if desired. Also as shown in FIG. 4, the mesh material (34) is sewn or otherwise secured onto itself along the head section (36) to produce a head sleeve (50) sized to accommodate the outer loop (12). The head section (36) is secured to the head cap (28) and foot cap (30) by cord or similar securement means to prevent undesired migration of the head section (36) along the outer loop (12). The foot section (38) is preferably sewn or otherwise directly secured to the containment band (14). Preferably, sections of nylon mesh material (52) are secured to the lengths of nylon webbing (44), covering the area between the seats (16) as shown in FIG. 3.

As shown in FIG. 4, although the seat (16) is of a generally flat construction, when utilized by a user (not shown), the lengths of nylon webbing (44) maintain the first side (40) and second side (42) relatively taut, while the mesh material (34) therebetween moves downward to form a seat (54), a back (56), a first bolster (58) and a second bolster (60). The size and construction of the mesh material (34) can be adjusted to create a lounger (10) designed for individuals of varying sizes, from small children to very large adults.

When it is desired to construct the lounger (10), the portion of the stiffening tube (26) extending from each resilient foam section (18) is inserted into the receiver tube (31) of the adjacent resilient foam section (18). Two additional resilient foam sections (62) without seats (16) are coupled to either end of the remaining resilient foam section chain (64) to create the outer loop (12). The additional foam sections (62) not provided with seats (16) create an entrance and egress (66) to allow users (not shown) to enter the lounger (10) and occupy a seat (16). Alternatively, the additional resilient foam sections (62) may be eliminated or extra seats provided thereupon.

Once the outer loop (12) is formed, the containment band (14) is threaded through the lower loops (48) of the seats (16), and tied off into a circle, prevents the seats (16) from collapsing. In the preferred embodiment, the containment band (14) is constructed of shock cord comprising continuous rubber strands with a nylon abrasion resistant jacket, such as other shock cords known in the art. This construction causes the seats (16) to support one another by the "tension web" created by the seats (16) being suspended between the outer loop (12) and the containment band (16). Cup holders (70), such as those known in the art, may be secured over the outer loop (12) if desired.

As shown in FIG. 2, the lounger (10) may be constructed with seven seats, or the lounger (10) may be constructed of any desired number of seats from two on up. Additionally, multiple resilient foam sections (18) or larger more volumous resilient foam sections (18) may be provided through the upper loops (46) of the seat (16) to provide additional buoyancy. Although additional types of buoyant material may be used to construct the outer loop (12), it is preferable that any such buoyant material not be of the inflatable type, or of a type which would result in any significant loss of buoyancy associated with a puncture.

Figure 5:
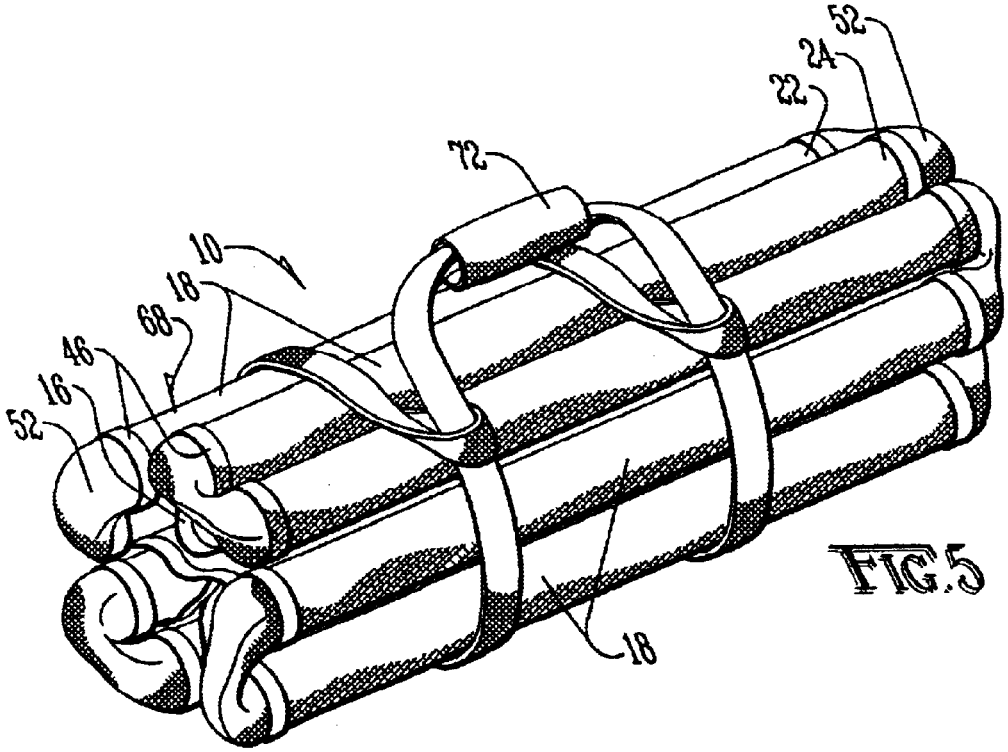
FIG. 5 illustrates a side perspective view of the buoyant lounger of the present invention shown in the transport orientation.

When it is desired to disassemble the lounger (10), the resilient foam sections (18) are removed from one another. As shown in FIG. 5, upon disassembly, the resilient foam sections (18) are coupled together to create a compact bundle (68). An even number of resilient foam sections (18) is preferred to aid in folding the longer into the compact bundle (68). A carrying strap (72) may then be wrapped around the resilient foam sections (18), looped upon itself, and utilized to transport and store the lounger (10). The carrying strap may be constructed of resilient shock cord, or may be of a non-resilient construction, with any desired type of cinchable restraint, such as a side release buckle, known in the art. Alternatively, each resilient foam section (18) may have a quick male disconnect assembly secured to its head (22) and a quick female disconnect assembly secured to its foot (24). A short piece of shock cord, provided on each end with quick disconnect assemblies, may also be threaded through the lower loop to create a seating section which may be quickly connected and disconnected from a plurality of other seating sections at any number or orientation.

In yet another alternative embodiment of the present invention a plurality of sleeves may be releasably provided over the ends of the resilient foam sections to hold the sections together.

Although the invention has been described with respect to a preferred embodiment thereof, it is also to be understood that it is not to be so limited, since changes and modifications can be made therein which are within the full, intended scope of this invention as defined by the appended claims.

What is claimed is:

1. A floatation lounger for use on water, said floatation lounger comprising:

(a) a loop formed of flexible resilient foam tube, having a substantially unobstructed portion comprising to an entrance to said flotation lounger;

(b) a containment band positioned within a perimeter defined by said loop;

(c) a first flexible seat having a head and a foot, wherein said head of said first flexible seat is coupled to said loop and wherein said foot of said first flexible seat is coupled to said containment band; and (d) a second flexible seat having a head and a foot wherein said head of said second flexible seat is coupled to said loop and wherein said foot of said second flexible seat is coupled to said containment band.

2. The floatation lounger of claim 1, wherein said loop is constructed of a first resilient foam tube section and a second resilient foam tube section.

3. The floatation lounger of claim 2, further comprising means for releasably securing said first resilient foam tube to said second resilient foam tube.

4. The floatation lounger of claim 2, further comprising a shaft releasably coupling said first resilient foam tube with said second resilient foam tube.

5. The floatation lounger of claim 4, wherein said shaft is provided with a smaller cross-sectional perimeter than a cross-sectional perimeter of said loop, wherein said shaft is secured into said first resilient foam tube at least substantially coaxially therewith, and wherein said shaft is secured into said second resilient foam tube at least substantially coaxially therewith.

6. The floatation lounger of claim 2, further comprising a sleeve releasably retaining an end of said first resilient foam tube section and an end of said second resilient foam tube section.

7. The floatation lounger of claim 1, wherein said first flexible seat and said second flexible seat are constructed of netting.

8. The floatation lounger of claim 7, wherein said head of said first flexible seat is a sleeve of said netting of a size sufficient to receive said loop.

9. The floatation lounger of claim 8, wherein said foot of said first flexible seat is a sleeve of said netting of a size sufficient to receive said containment band.

10. The floatation lounger of claim 1, wherein said loop is constructed of a plurality of resilient foam sections releasably coupled to one another by a resilient cord running at least partially through said plurality of resilient foam tubes.

11. The floatation lounger of claim 1, further comprising:

(a) a third flexible seat having a head and a foot, wherein said head of said first flexible seat is coupled to said loop and wherein said foot of said first flexible seat is coupled to said containment band;

(b) a fourth flexible seat having a head and a foot, wherein said head of said first flexible seat is coupled to said loop and wherein said foot of said first flexible seat is coupled to said containment band; and (c) a fifth flexible seat having a head and a foot, wherein said head of said first flexible seat is coupled to said loop and wherein said foot of said first flexible seat is coupled to said containment band.

12. The floatation lounger of claim 11, wherein said entrance is at least one half meter in length.

13. A flotation lounger for use on water, said floatation lounger comprising:

(a) a buoyant loop having a substantially unobstructed portion comprising an entrance to said flotation lounger, said buoyant loop comprising:
  (i) a plurality of flexible resilient foam tubes; and
  (ii) means for releasably securing said flexible resilient foam tubes into a closed loop;

(b) containment band provided within said buoyant loop; and (c) a plurality of seats comprising:
  (i) a flexible seating area;
  (ii) a head coupled to said buoyant loop; and
  iii) a foot coupled to said containment band.

14. The floatation lounger of claim 13, wherein said plurality of seats includes at least four seats.

15. The floatation lounger of claim 13, wherein said releasably securing means is a resilient cord running at least partially through said plurality of resilient foam tubes.

16. The floatation lounger of claim 13, wherein when in use said plurality of seats each comprise:

(a) a seat;

(b) a back;

(c) a first bolster; and (d) a second bolster.

17. The floatation lounger of claim 13, further comprising a substantially unobstructed portion of said buoyant loop comprising an entrance to said floatation lounger.

18. A floatation lounger comprising:

(a) a plurality of flexible resilient foam tubes;

(b) means for coupling said plurality of flexible resilient foam tubes into a buoyant closed loop having a substantially unobstructed portion comprising an entrance to said flotation lounger;

(c) a containment band provided within a perimeter defined by said buoyant closed loop;

(d) a first seat comprising:
  (i) a flexible seat area;
  (ii) a head coupled to said buoyant closed loop; and
  (iii) a foot coupled to said containment band;

(e) a second seat comprising:
  (i) a flexible seat area;
  (ii) a head coupled to said buoyant closed loop; and
  (iii) a foot coupled to said containment band;

(f) a third seat comprising:
  (i) a flexible seat area;
  (ii) a head coupled to said buoyant closed loop; and
  (iii) a foot coupled to said containment band;

(g) a fourth seat comprising:
  (i) a flexible seat area;
  (ii) a head coupled to said buoyant closed loop; and
  (iii) a foot coupled to said containment band;

(h) a fifth seat comprising:
  (i) a flexible seat area;
  (ii) a head coupled to said buoyant closed loop; and
  (iii) a foot coupled to said containment band.

19. The floatation lounger of claim 18, wherein, when in use, said first seat comprises:

(a) a seat;

(b) a back;

(c) a first bolster; and (d) a second bolster.

20. The floatation lounger of claim 18, wherein said first seat, said second seat, said third seat, said fourth seat and said fifth seat are asymmetrically spaced to define said entrance between at least two of said seats.

* * * * *